US007024861B2

(12) United States Patent
Martling

(10) Patent No.: US 7,024,861 B2
(45) Date of Patent: Apr. 11, 2006

(54) FULLY PREMIXED PILOTLESS SECONDARY FUEL NOZZLE WITH IMPROVED TIP COOLING

(76) Inventor: Vincent C. Martling, 10296 Sandy Run Rd., Jupiter, FL (US) 33478

( * ) Notice: Subject to any disclaimer, the term of this patent is extended or adjusted under 35 U.S.C. 154(b) by 107 days.

(21) Appl. No.: 10/652,105

(22) Filed: Aug. 29, 2003

(65) Prior Publication Data

US 2004/0118120 A1 Jun. 24, 2004

Related U.S. Application Data

(63) Continuation-in-part of application No. 10/324,949, filed on Dec. 20, 2002, now Pat. No. 6,813,890.

(51) Int. Cl.
*F02C 7/22* (2006.01)

(52) U.S. Cl. ..... 60/737; 60/740

(58) Field of Classification Search ..... 60/734, 60/737, 739, 740, 746, 747
See application file for complete search history.

(56) References Cited

U.S. PATENT DOCUMENTS

| | | | | |
|---|---|---|---|---|
| 4,982,570 | A | 1/1991 | Waslo et al. | |
| 5,199,265 | A | 4/1993 | Borkowicz | |
| 6,282,904 | B1 | 9/2001 | Kraft et al. | |
| 6,363,724 | B1 | 4/2002 | Bechtel et al. | |
| 6,446,439 | B1 | 9/2002 | Kraft et al. | |
| 6,453,673 | B1 | 9/2002 | Bechtel et al. | |
| 6,460,326 | B1 | 10/2002 | Bechtel et al. | |
| 6,675,581 | B1 * | 1/2004 | Stuttaford et al. | 60/737 |
| 6,691,516 | B1 * | 2/2004 | Stuttaford et al. | 60/737 |
| 6,698,207 | B1 * | 3/2004 | Wiebe et al. | 60/737 |

OTHER PUBLICATIONS

U.S. Appl. No. 10/195,615, filed Jul. 1963, Stuttaford et al.
U.S. Appl. No. 10/452,449, filed Dec. 25,2001, Stuttaford et al.
U.S. Appl. No. 10/195,823, filed Aug. 1963, Stuttaford et al.
U.S. Appl. No. 10/465,096, filed Nov. 5, 2002, Stuttaford et al.
U.S. Appl. No. 10/389,523, filed Jan. 20, 1998, Martling.

* cited by examiner

*Primary Examiner*—Louis J. Casaregola

(57) ABSTRACT

A premix secondary fuel nozzle for use in transferring a flame from a first combustion chamber to a second combustion chamber is disclosed. The secondary fuel nozzle includes multiple fuel circuits, each of which are fully premixed, and neither of which are injected in a manner to directly initiate or support a pilot flame, thereby lowering emissions. Multiple embodiments are disclosed for alternate configurations of a first fuel injector, including an annular manifold and a plurality of radially extending tubes. Alternate premix secondary fuel nozzles are also disclosed incorporating improved tip cooling schemes that reduce the amount of cooling flow and increase the local heat transfer effectiveness. Reduced cooling flow to the tip region helps to improve flame stability and lower combustion dynamics by eliminating unnecessary cooling air from the fuel nozzle recirculation zone.

16 Claims, 7 Drawing Sheets

FULLY PREMIXED PILOTLESS SECONDARY FUEL NOZZLE WITH IMPROVED TIP COOLING

This application is a continuation-in-part of U.S. patent application Ser. No. 10/324,949, filed Dec. 20, 2002 now U.S. Pat. No. 6,813,890 and assigned to the same assignee hereof.

BACKGROUND OF THE INVENTION

1. Field of the Invention

This invention relates generally to a premix fuel nozzle for use in a gas turbine combustor and more specifically to a premix fuel nozzle that does not contain a fuel circuit dedicated to support a pilot flame.

2. Description of Related Art

The U.S. Government has enacted requirements for lowering pollution emissions from gas turbine combustion engines, especially nitrogen oxide (NOx) and carbon monoxide CO. These emissions are of particular concern for land based gas turbine engines that are used to generate electricity since these types of engines usually operate continuously and therefore emit steady amounts of NOx and CO. A variety of measures have been taken to reduce NOx and CO emissions including the use of catalysts, burning cleaner fuels such as natural gas, and improving combustion system efficiency. One of the more significant enhancements to land based gas turbine combustion technology has been the use of premixing fuel and compressed air prior to combustion. An example of this technology is shown in FIG. 1 and discussed further in U.S. Pat. No. 4,292,801. FIG. 1 shows a dual stage dual mode combustor typically used in a gas turbine engine for generating electricity. Combustor 12 has first stage combustion chamber 25 and a second stage combustion chamber 26 interconnected by a throat region 27, as well as a plurality of diffusion type fuel nozzles 29. Depending on the mode of operation, combustion may occur in first stage combustion chamber 25, second stage combustion chamber 26, or both chambers. When combustion occurs in second chamber 26, the fuel injected from nozzles 29 mixes with air in chamber 25 prior to ignition in second chamber 26. As shown in FIG. 1, an identical fuel nozzle 29 is positioned proximate throat region 27 to aid in supporting combustion for second chamber 26. While the overall premixing effect in first chamber 25 serves to reduce NOx and CO emissions from this type combustor, further enhancements have been made to the centermost fuel nozzle since fuel and air from this fuel nozzle undergo minimal mixing prior to combustion.

A combined diffusion and premix fuel nozzle, which is shown in FIG. 2, has been used instead of the diffusion type fuel nozzle shown proximate throat region 27 in FIG. 1. Although an improvement was attained through premix nozzle 31, this nozzle still contained a fuel circuit 32 that contained fuel that did not adequately mix with air prior to combusting and therefore contributed to elevated levels of NOx and CO emissions. As a result, this fuel nozzle was modified such that all fuel that was injected into a combustor was premixed with compressed air prior to combustion to create a more homogeneous fuel/air mixture that would burn more completely and thereby result in lower emissions. This improved fully premixed fuel nozzle is shown in FIG. 3 and discussed further in U.S. Pat. No. 6,446,439. Fuel nozzle 50 contains a generally annular premix nozzle 51 having a plurality of injector holes 52 and a premix pilot nozzle 53 with a plurality of feedholes 54. In this pilot circuit embodiment, fuel enters a premix passage 55 from premix pilot nozzle 53 and mixes with air from air flow channels 56 to form a premixture. Fuel nozzle 50 is typically utilized along the centerline of a combustor similar to that shown in FIG. 1 and aids combustion in second chamber 26. Although the fully premixed fuel nozzle disclosed in FIG. 3 provides a more homogeneous fuel/air mixture prior to combustion than prior art fuel nozzles, disadvantages to the fully premixed fuel nozzle have been discovered, specifically relating to premix pilot nozzle 53. More specifically, in order to maintain emissions levels in acceptable ranges, premix pilot feed holes 54 had to be adjusted depending on the engine type, mass flow, and operating conditions. This required tedious modifications to each nozzle either during manufacturing or during assembly and flow testing, prior to installation on the engine.

In order to simplify the fuel nozzle structure and further improve emissions, it is desirable to have a fuel nozzle that supports combustion in a second combustion chamber 26 without having a pilot circuit. Elimination of a pilot circuit, whether diffusion or premix, will further reduce emissions since the pilot circuit is always in operation whether or not it was actually needed to support combustion. Furthermore, eliminating the pilot circuit will simplify fuel nozzle design and manufacturing. The major concern with eliminating the pilot circuit is combustion stability in the second combustion chamber given the reduced amount of dedicated fuel flow to the secondary fuel nozzle. Experimental testing was conducted on a gas turbine combustor having first and second combustion chambers by blocking the premix pilot nozzle 53 of fuel nozzle 50 in accordance with FIG. 3. The combustor was run through its entire range of operating conditions and positive results were obtained for maintaining a stable flame in the second combustion chamber. Changes in combustion dynamics or pressure fluctuations associated with the elimination of the pilot fuel circuit were found to be minimal and insignificant for typical operating conditions.

An additional concern with prior art fuel nozzles relates to the amount of cooling air directed to the nozzle tip. While providing air to cool the nozzle tip region is necessary to prevent damage from exposure to the elevated temperatures, too much air can adversely affect combustion dynamics. This is especially a concern for fuel nozzles not having a pilot fuel circuit.

SUMMARY AND OBJECTS OF THE INVENTION

An improved fully premixed secondary fuel nozzle for use in a gas turbine combustor having multiple combustion chambers, in which the products of premixed secondary fuel nozzle are injected into the second combustion chamber, is disclosed. The improvement includes the elimination of the pilot fuel circuit, which previously served to support ignition and combustion in the second combustion chamber. The improved premix secondary fuel nozzle includes a first injector extending radially outward from the fuel nozzle body for injecting a fuel to mix with compressed air prior to combustion, a second injector located at the tip region of the fuel nozzle for injecting an additional fluid, either fuel or air, depending on mode of operation, and an air cooled tip having a swirler. In the preferred embodiment, the first injector is an annular manifold extending radially outward from the fuel nozzle by a plurality of support members and contains a plurality of first injector holes. Also in the preferred embodiment, the second injector is in fluid communication with a plurality of transfer tubes that transfer a fluid to the second injector from around the region of the fuel nozzle that contains the cooling air. In an alternate embodiment of the present invention, the first injector comprises a plurality of radially extending tubes and the second injector is in fluid communication with a generally annular passage that transfers a fluid to the second injector from upstream of the first injector.

In a second and third alternate embodiments of the present invention, a redesigned nozzle tip region is disclosed incorporating an improved cooling scheme that utilizes less cooling air such that combustion dynamics are reduced. This is accomplished by reducing the total airflow passing through the tip region and changing the means of introducing the cooling air to the combustion chamber. Two nozzle tip regions are disclosed incorporating this alternate cooling configuration. One configuration contains a plurality of cooling holes generally perpendicular to a tip plate while the other orients the cooling holes at an angle, thereby lengthening the cooling holes for enhanced heat transfer and introducing a swirl to the combustor.

It is an object of the present invention to provide an improved premix secondary fuel nozzle for use in a gas turbine combustor having a plurality of combustion chambers that does not contain a fuel circuit dedicated to the initiation and support of a pilot flame.

It is a further object of the present invention to provide a gas turbine combustor having stable combustion while producing lower NOx and CO emissions.

It is yet another object of the present invention to provide an improved premix secondary fuel nozzle for use in a gas turbine combustor having reduced combustion dynamics and a more stable flame front.

In accordance with these and other objects, which will become apparent hereinafter, the instant invention will now be described with particular reference to the accompanying drawings.

DETAILED DESCRIPTION OF THE PREFERRED EMBODIMENT

Figure 1:
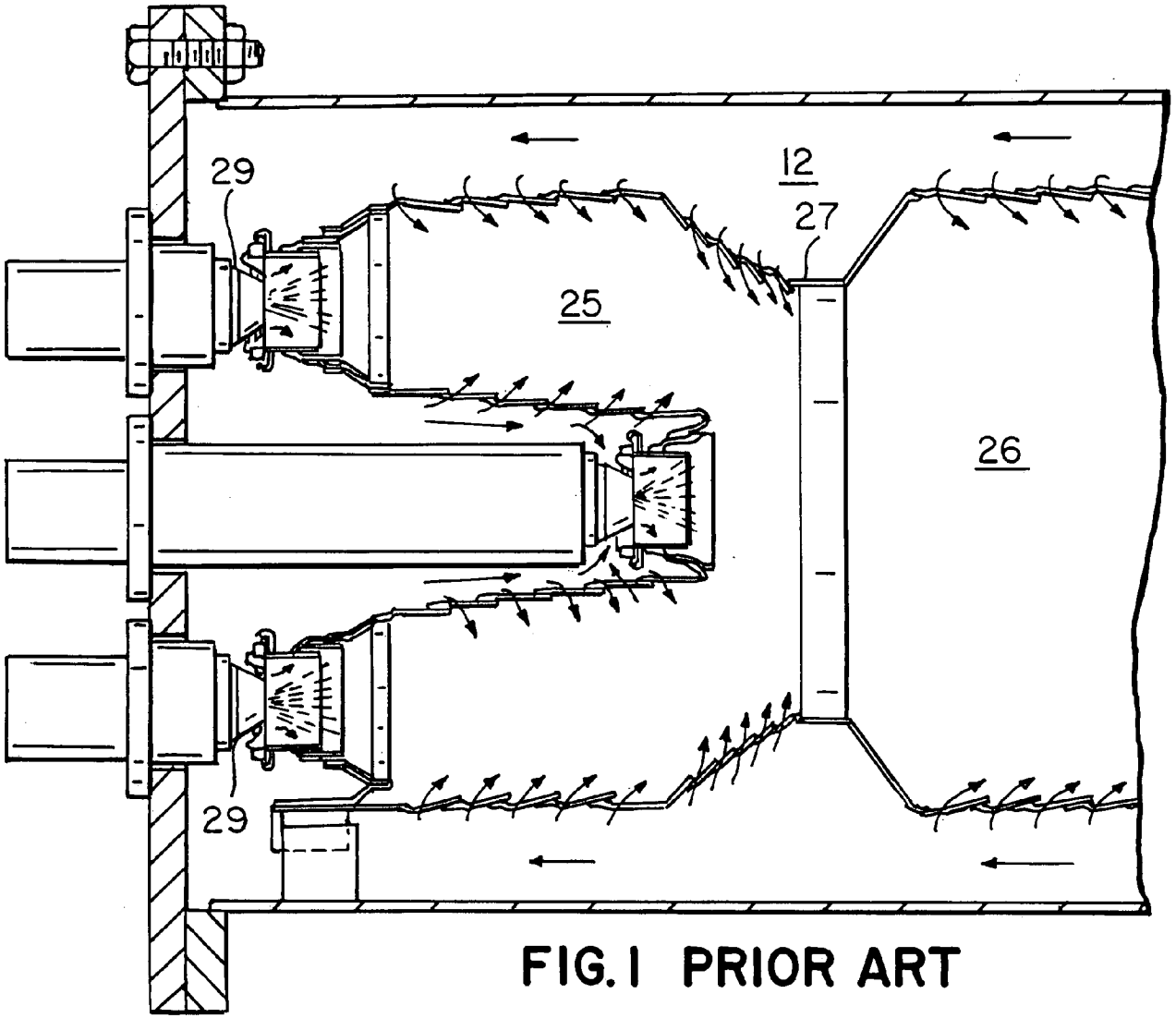
FIG. 1 PRIOR ART
FIG. 1 is a partial cross section view of a gas turbine combustor of the prior art having first and second combustion chambers.
Figure 2:
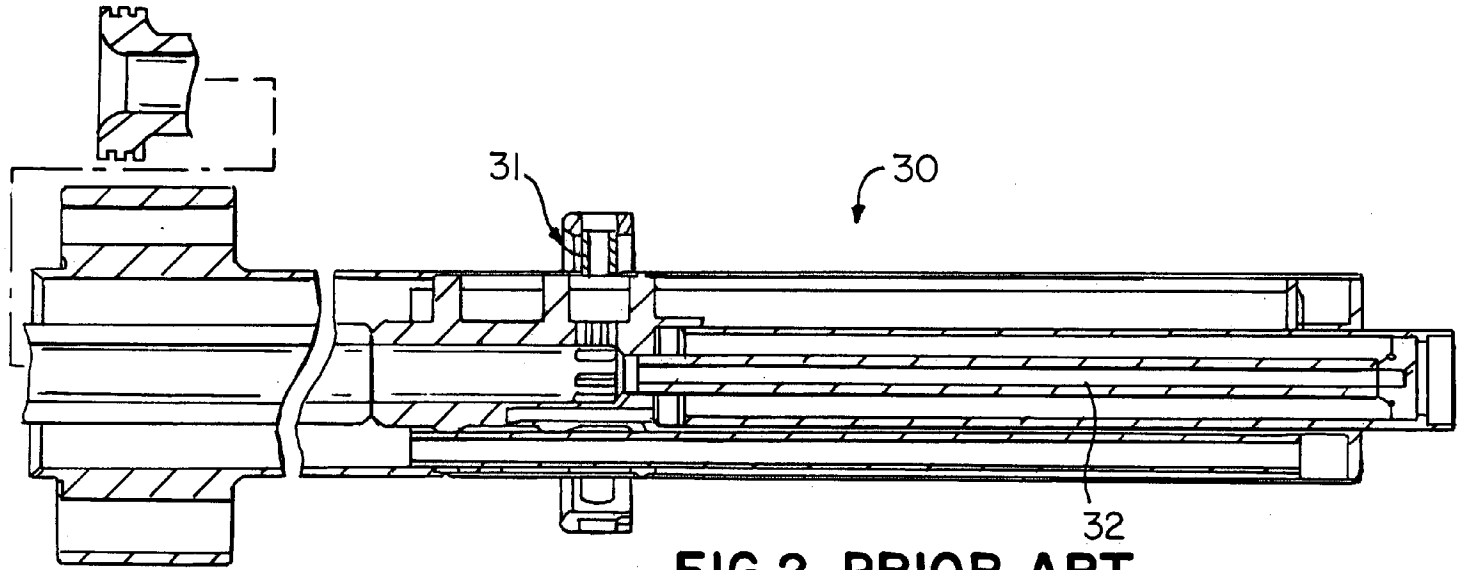
FIG.2 PRIOR ART
FIG. 2 is a partial cross section view of a secondary fuel nozzle of the prior art.
Figure 3:
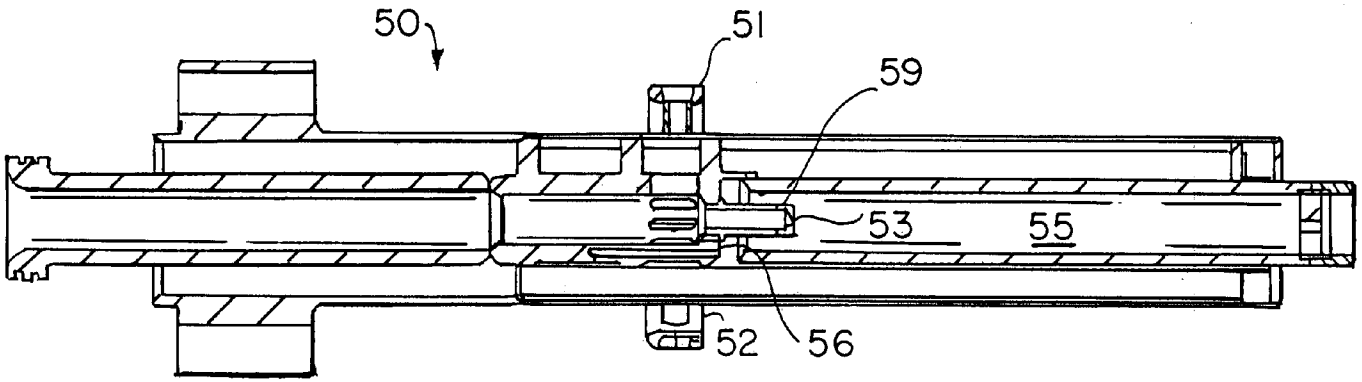
FIG.3 PRIOR ART
FIG. 3 is a cross section view of a premix secondary fuel nozzle of the prior art.
Figure 4:
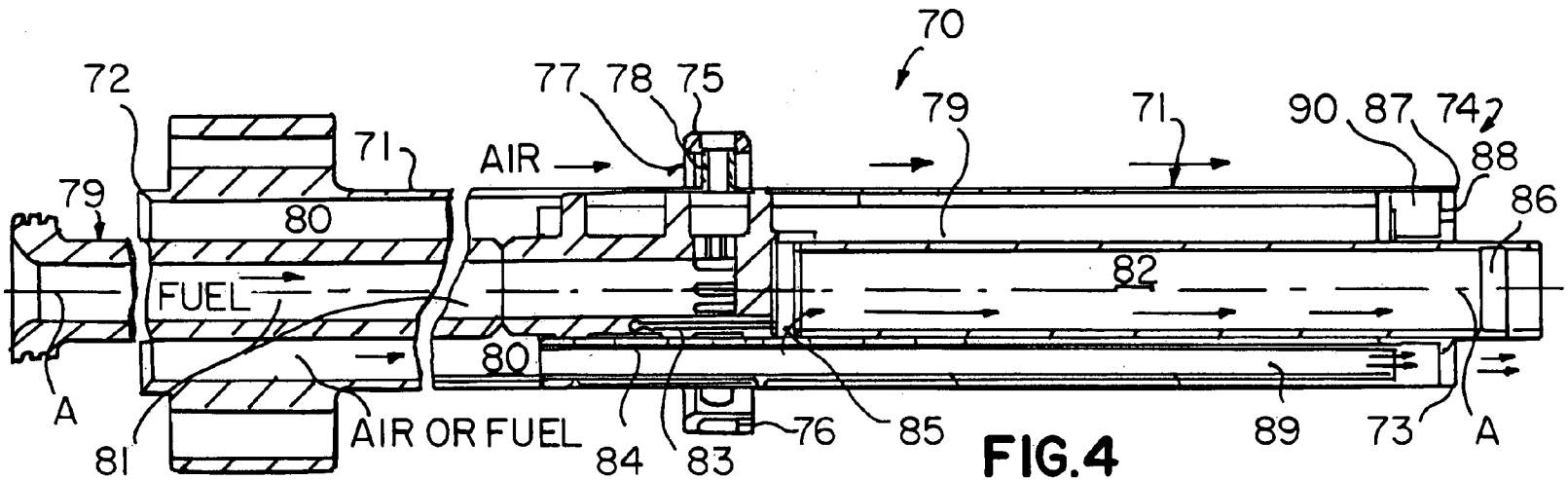
FIG. 4 is a partial cross section view of a premix secondary fuel nozzle in accordance with the preferred embodiment of the present invention.
Figure 6:
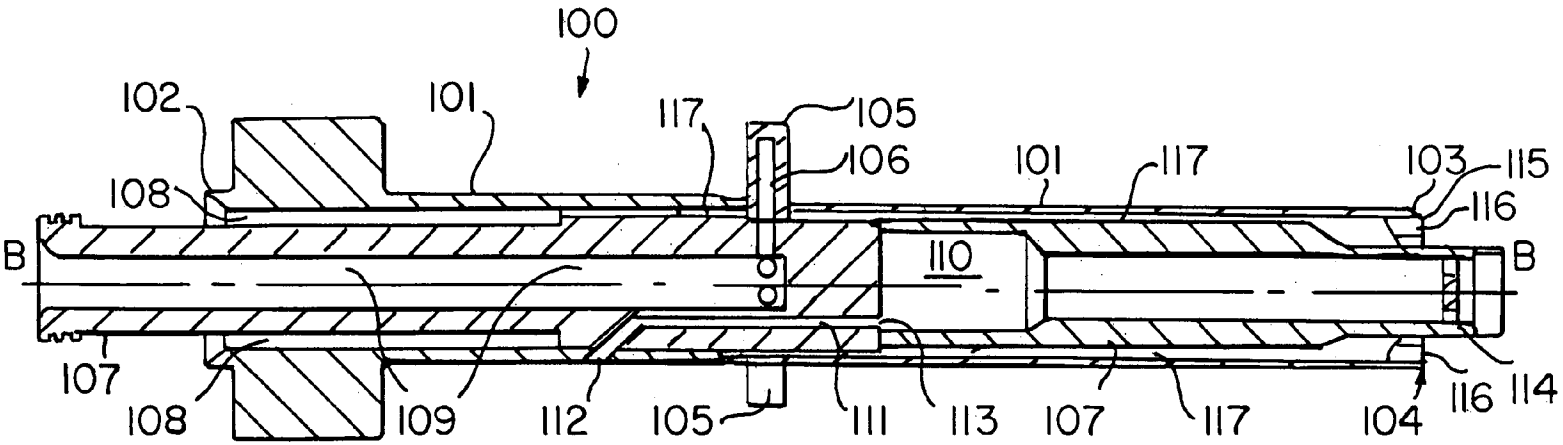
FIG. 6 is a cross section view of a premix secondary fuel nozzle in accordance with an alternate embodiment of the present invention.
Figure 5:
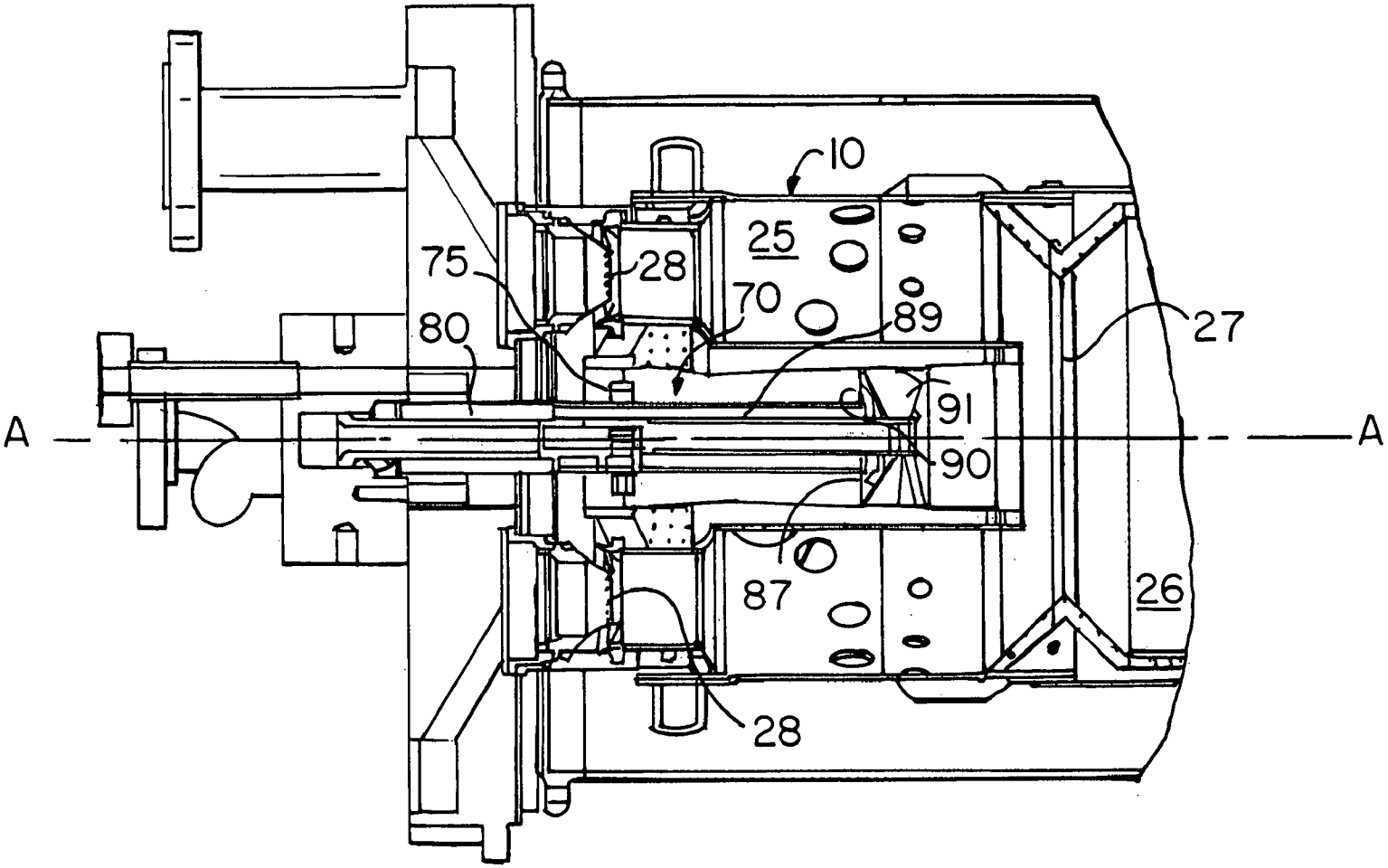
FIG. 5 is a partial cross section of a gas turbine combustor utilizing the preferred embodiment of the present invention.

The present invention will now be described in detail and is shown in FIGS. 4 through 6. Referring now to FIG. 4, which is the preferred embodiment, a premixed secondary fuel nozzle 70 is shown in cross section. Secondary fuel nozzle 70 is utilized primarily to support combustion in a second combustion chamber of a gas turbine combustor having a plurality of combustion chambers. Secondary fuel nozzle 70 is comprised of an elongated tube 71 having a first end 72, an opposing second end 73, a centerline A—A defined therethrough, and a tip region 74 proximate second end 73. Fuel nozzle 70 also contains at least one first injector 75, which extends radially away from and is fixed to elongated tube 71. First injector 75 contains at least one first injector hole 76 for injecting a fuel into a combustor such that air surrounding fuel nozzle 70 mixes with the fuel to form a premixture. In the preferred embodiment, first injector 75 comprises an annular manifold 77 circumferentially disposed about elongated tube 71 and affixed to a plurality of support members 78 which are affixed to elongated tube 71. In this embodiment, at least one first injector hole 76 comprises a plurality of holes situated about the periphery of annular manifold 77 and are oriented to inject fuel in a downstream direction with at least one first injector hole being circumferentially offset from support members 78. Furthermore, in order to provide the appropriate fuel distribution from first injector holes 76, at least one of first injectors holes 76 is angled relative to the downstream direction.

Secondary fuel nozzle 70 also includes a central core 79 coaxial with centerline A—A and located radially within elongated tube 71 thereby forming a first passage 80 between central core 79 and elongated tube 71. Central core 79 extends from proximate first opposing end 72 to proximate second opposing end 73 and contains a second passage 81, which extends from proximate first opposing end 72 to proximate first injector 75 and is in fluid communication with first injector 75. Located axially downstream from second passage 81, contained within central core 79, and extending to proximate second opposing end 73, is a third passage 82, which along with second passage 81 is coaxial with centerline A—A. Central core 79 also contains a plurality of airflow channels 83, typically seven, which have an air flow inlet region 84, an airflow exit region 85, and are in fluid communication with third passage 82. Due to the geometry of air flow channels 83 and positioning of air flow inlet region 84, first passage 80 extends from proximate first opposing end 72 to a point upstream of air flow inlet region 84.

Positioned proximate nozzle tip region 74 and fixed within third passage 82 is a swirler 86 that is used to impart a swirl to air from third passage 82 for cooling nozzle tip region 74. Also located proximate nozzle tip region 74 at second opposing end 73 is a second injector 87 which contains a plurality of second injector holes 88 for injecting a fluid medium into a combustor. The fluid medium injected through second injector initiates in first passage 80 and is transferred to second injector 87, in the preferred embodiment, by means of a plurality of transfer tubes 89, typically seven, which have opposing ends and surround third passage 82. Transfer tubes 89 extend from upstream of first injector 75 to an annular plenum 90, which is adjacent second injector 87. Depending on the mode of operation, first passage 80, transfer tubes 89, and annular plenum 90, may contain either fuel or air. For a combustor having a first combustion chamber and a second combustion chamber, as shown in FIG. 5, fuel is supplied to first passage 80, transfer tubes 89, and annular plenum 90 and injected through second injector 87 in an effort to transfer the flame from a first combustion chamber to a second combustion chamber. In this type of combustion system 10 there is a first combustion chamber or primary combustion chamber 25 and at least one primary fuel nozzle 28 delivering fuel to primary combustion chamber 25 where initial combustion occurs. Adjacent to and downstream of primary combustion chamber 25 is a secondary combustion chamber 26 with the combustion chambers separated by a venturi 27. Primary fuel nozzles 28 surround secondary fuel nozzle 70, which injects fuel towards secondary combustion chamber 26 to support combustion downstream of venturi 27. From FIG. 5 it can be seen that all fuel from premix secondary fuel nozzle 70 is injected such that it must premix with the surrounding air and pass through cap swirler 91 prior to entering secondary combustion chamber 26. Prior art designs allowed fuel from secondary fuel nozzles to pass directly into secondary combustion chamber 26 without passing through cap swirler 91, thereby directly initiating and supporting a pilot flame, which is typically a source of high emissions.

Referring now to FIG. 6, an alternate embodiment of the present invention is shown in cross section. The alternate embodiment is similar to the preferred embodiment in structure and identical to the preferred embodiment in purpose and function. A premix secondary fuel nozzle 100 contains an elongated tube 101 having a first end 102 and an opposing second end 103, a centerline B—B defined therethrough, and a tip region 104 proximate second end 103. Extending radially away and fixed to elongated tube 101 is at least one first injector 105 having at least one first injector hole 106 for injecting a fuel into a combustor so that the surrounding air mixes with the fuel to form a premixture. In the alternate embodiment, at least one first injector comprises a plurality of radially extending tubes, with each of the tubes having at least one first injector hole 106 that injects fuel in the downstream direction. Fuel injection may be directly downstream or first injector holes maybe oriented at an angle relative to the downstream direction to improve fuel distribution in the surrounding air.

Alternate premix secondary fuel nozzle 100 also contains a central core 107 coaxial with centerline B—B and located radially within elongated tube 101 to thereby form a first passage 108 between central core 107 and elongated tube 101. Central core 107 extends from proximate first opposing end 102 to second opposing end 103 and contains a second passage 109 that extends from proximate first opposing end 102 to proximate first injector 105 and is in fluid communication with first injector 105. Central core 107 also contains a third passage 110 that extends from downstream of first injector 105 to proximate second opposing end 103 such that third passage 110 and second passage 109 are both coaxial with centerline B—B. Another feature of central core 107 is the plurality of air flow channels 111 that are in fluid communication with third passage 110 and each having an air flow inlet region 112 and an air flow exit region 113. Air passes from air flow channels 111, through third passage 110, and flows through a swirler 114, which is fixed within third passage 110 for imparting a swirl to the air, in order to more effectively cool tip region 104.

A second injector 115 is positioned at second end 103, proximate nozzle tip region 104, and contains a plurality of second injector holes 116 for injecting a fluid medium into a combustor. The fluid medium injected through second injector 115 initiates in first passage 108 and flows around central core 107 through a generally annular passageway 117 while being transferred to second injector. Depending on the mode of operation, first passage 108 and annular passage 117 may contain either fuel or air. For a combustor having a first combustion chamber and a second combustion chamber, and as shown in FIG. 5, fuel is supplied to first passage 108, annular passage 117, and injected through second injector 115 in an effort to transfer the flame from a first combustion chamber 25 to a second combustion chamber 26. As with the preferred embodiment, all fuel for combustion from the alternate embodiment secondary fuel nozzle is injected radially outward of and upstream of swirler 114 such that the fuel is injected in a manner that must premix with the surrounding air and pass through cap swirler 91 prior to entering secondary combustion chamber 26.

Referring now to FIGS. 7–10B, second and third alternate embodiments of the present invention are shown in detail. In each of these alternate embodiments, the tip region of the premix fuel nozzle is modified to reduce the amount of air required to sufficiently cool the nozzle tip, and thereby injected into the recirculation zone. As a result, flame stability improves and combustion dynamics are decreased. The preferred embodiment of the present invention discloses a pilotless fuel nozzle configuration that utilizes cooling air from third passage 82 and directs it through swirler 86 for cooling nozzle tip region 74. It has been determined that in a pilotless fuel nozzle configuration of this geometry, lesser amounts of air are actually required to cool the nozzle tip than previously thought. Without a pilot fuel circuit, the air passing through third passage 82 and swirler 86 provided a dilution effect to the recirculation zone created by cap swirler 91 thereby reducing the combustion stability and raising combustion dynamics. By reducing the amount of cooling air flow and changing the nozzle tip geometry to utilize the reduced cooling flow more efficiently, combustion dynamics are reduced and a more stable flame front is established. The nozzle tip geometry can be altered to maintain sufficient tip cooling while utilizing less cooling air through the use of effusion cooling, comprising a plurality of holes arranged in an array about a thicker plate of material, thereby maximizing the cooling capability of the air throughout the plate thickness.

Figure 7:
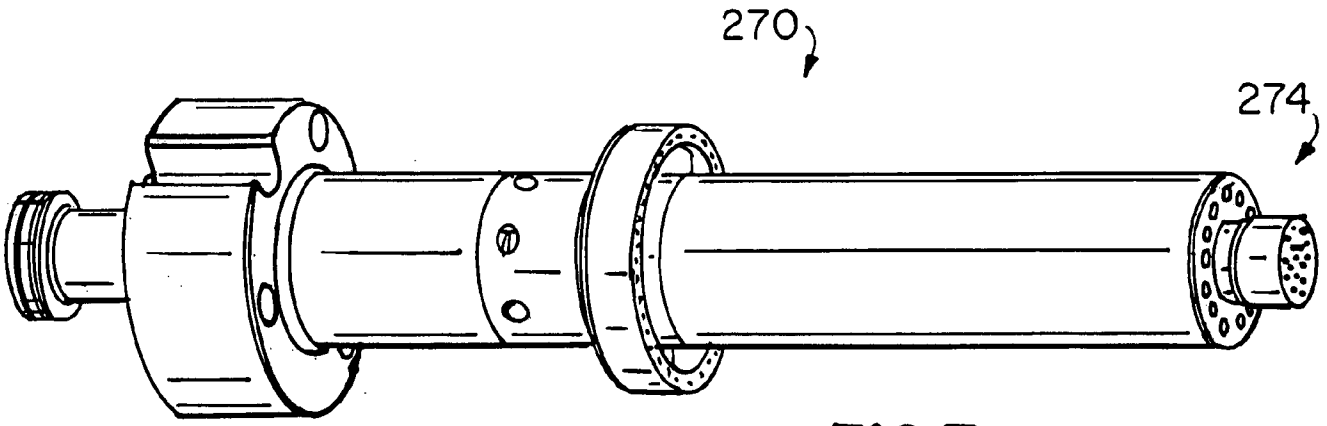
FIG. 7 is a perspective view of a premix secondary fuel nozzle in accordance with a second alternate embodiment of the present invention.
Figure 8:
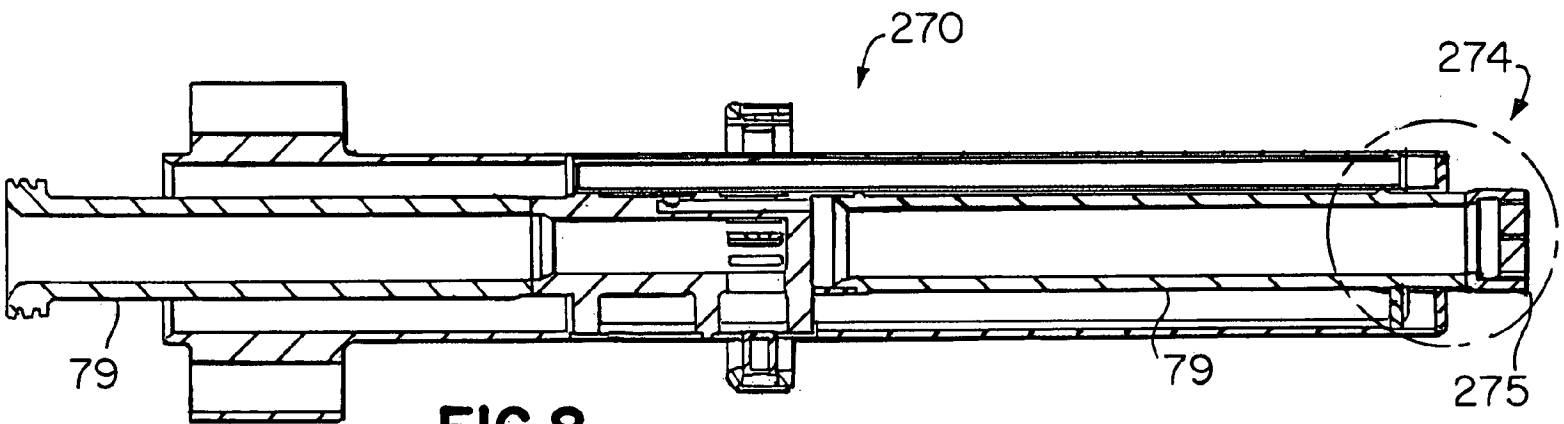
FIG. 8 is a cross section view of a premix secondary fuel nozzle in accordance with a second alternate embodiment of the present invention.
Figure 9B:
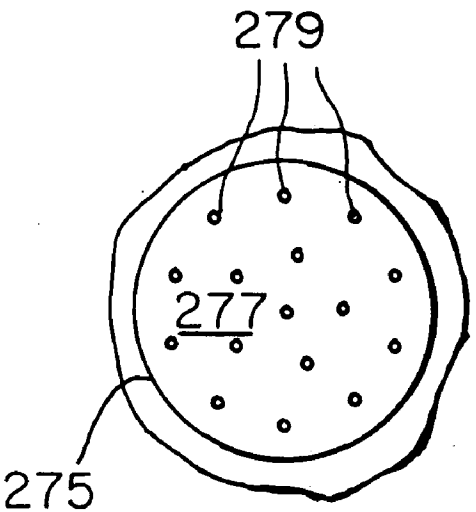
FIG. 9B is a partial end view of the tip region of a premix secondary fuel nozzle in accordance with a second alternate embodiment of the present invention.
Figure 9A:
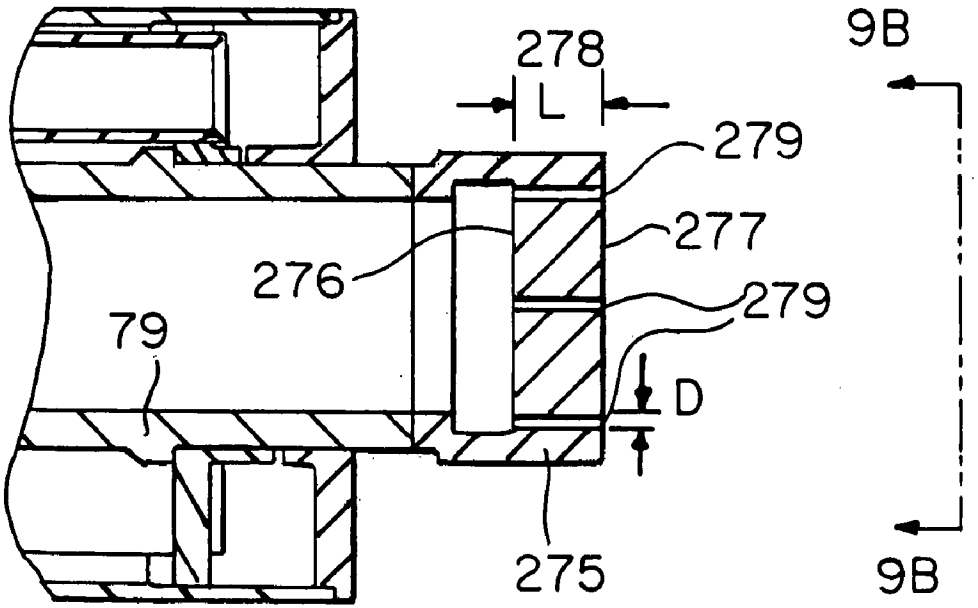
FIG. 9A is a partial cross section view of the tip region of a premix secondary fuel nozzle in accordance with a second alternate embodiment of the present invention.

Referring to FIG. 7, a premix secondary fuel nozzle 270 in accordance with a second alternate embodiment is shown in perspective view. The focal point of the second and third alternate embodiments are located at tip region 274 with all other features of the premix secondary fuel nozzle identical to those disclosed in the preferred embodiment. Therefore, only the new matter will be discussed further. Referring now to FIG. 8, premix secondary fuel nozzle 270 is shown in cross section view with tip region 274 detailed in FIGS. 9A and 9B. Premix secondary fuel nozzle 270 includes a tip plate 275 fixed to central core 79 proximate tip region 274 having a first surface 276, a second surface 277, and a plate thickness 278 therebetween. For the second alternate embodiment, the preferred plate thickness 278 is at least 0.125 inches. Tip plate 275 also contains a plurality of cooling holes 279 extending from first surface 276 to second surface 277 such that cooling holes 279 have a hole length L and a diameter D ranging from 0.020 inches to 0.070 inches. In the second alternate embodiment, cooling holes 279 are generally perpendicular to second surface 277 such that hole length L is equal to plate thickness 278. For example, in the second alternate embodiment shown in FIG. 9A, tip region has a plate thickness of 0.312 inches and contains cooling holes having a diameter D of 0.040 inches, thereby resulting in a L/D ratio of slightly less than eight. For most applications, the L/D ratio will be approximately 6–8, but could vary depending on fuel nozzle and combustor conditions.

Figure 10B:
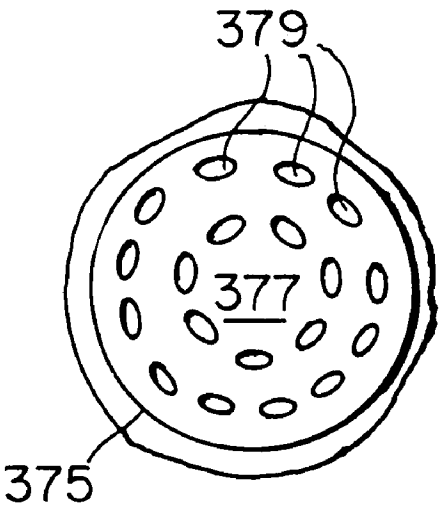
FIG. 10B is a partial end view of the tip region of a premix secondary fuel nozzle in accordance with a third alternate embodiment of the present invention.
Figure 10A:
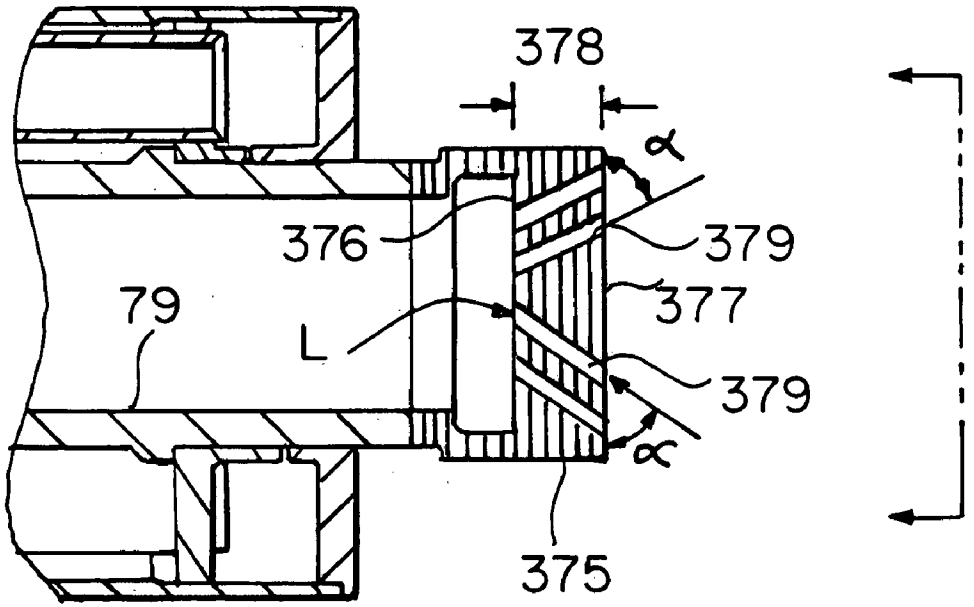
FIG. 10A is a partial cross section of the tip region of a premix secondary fuel nozzle in accordance with a third alternate embodiment of the present invention.

A tip region 374 for a third alternate embodiment of the present invention is shown in detail in FIGS. 10A and 10B. In this third alternate embodiment a tip plate 375 has a first surface 376, a second surface 377, and a plate thickness 378 therebetween. The preferred plate thickness 378 for the third alternate embodiment is the same as for the second alternate embodiment, at least 0.125 inches. Tip plate 375 also contains a plurality of cooling holes 379 extending from first surface 376 to second surface 377 with cooling holes 379 oriented at an angle $\alpha$ with respect to second surface 377, having a diameter D ranging from 0.020 inches to 0.070 inches, and having a length L. Angling cooling holes 379 allows for a longer hole to be placed in the same thickness material as a straight hole would, thereby increasing the heat transfer effect of the cooling air as well introducing a swirl to the flow exiting tip plate 375. It is preferred that angle $\alpha$ range between 25 and 45 degrees. As a result of angle $\alpha$, hole length L of cooling holes 379 is greater than plate thickness 378.

While the invention has been described in what is known as presently the preferred embodiment, it is to be understood that the invention is not to be limited to the disclosed embodiment but, on the contrary, is intended to cover various modifications and equivalent arrangements within the scope of the following claims.

The invention claimed is:

1. An improved premix secondary fuel nozzle for use in a gas turbine combustor comprising:

an elongated tube having a first and second opposing ends having a centerline defined therethrough and a tip region proximate said second end;

at least one first injector extending radially away from and fixed to said elongated tube and containing at least one first injector hole for injecting a fuel into said combustor such that air surrounding said fuel nozzle mixes with said fuel to form a premixture;

a central core coaxial with said centerline and located radially within said elongated tube thereby forming a first passage between said central core and said elongated tube, said central core extending from proximate said first opposing end to proximate said second opposing end, said central core containing a second passage extending from proximate said first opposing end to proximate said first injector for supplying fuel to said first injector, said central core also containing a third passage extending from downstream of said first injector to proximate said second opposing end, each of said second and third passages coaxial with said centerline, and said central core further containing a plurality of air flow channels in fluid communication with said third passage, said air flow channels having an air flow inlet region and air flow exit region, and said first passage extending from proximate said first opposing end to upstream of said air flow inlet region of said air flow channels;

a tip plate fixed to said central core proximate said tip region, said tip plate having a first surface, a second surface, a plate thickness therebetween, and a plurality of cooling holes extending from said first surface to said second surface such that said cooling holes have a hole length L;

a second injector containing a plurality of second injector holes located proximate said second opposing end of said elongated tube for injecting a fluid medium into said combustor;

means for transferring said fluid medium from said first passage to said second injector;

wherein all fuel is injected radially outward of and upstream of said tip plate so as to not directly initiate a pilot flame.

2. The improved premix secondary fuel nozzle of claim 1 wherein said first injector comprises an annular manifold circumferentially disposed about said elongated tube and affixed to a plurality of support members, said support members affixed to said elongated tube such that said annular manifold is in fluid communication with said second passage, said annular manifold having a plurality of first injector holes situated about its periphery and oriented to inject said fuel in a downstream direction, at least one of said first injector holes being circumferentially offset from said support members.

3. The improved premix secondary fuel nozzle of claim 2 wherein at least one of said first injector holes of said annular manifold is angled relative to the downstream direction.

4. The improved premix secondary fuel nozzle of claim 1 wherein said means for transferring said medium includes a plurality of transfer tubes having opposing ends, said transfer tubes surrounding said third passage and extending from upstream of said first injector to an annular plenum proximate said second injector.

5. The improved premix secondary fuel nozzle of claim 4 wherein said fluid medium can be either fuel or air, depending on combustor mode of operation.

6. The improved premix secondary fuel nozzle of claim 4 wherein seven of said transfer tubes surrounds seven of said airflow channels.

7. The improved premix secondary fuel nozzle of claim 1 wherein said first injector comprises a plurality of radially extending tubes, each of said tubes having at least one first hole, said hole injecting said fuel in the downstream direction, said plurality of radially extending tubes are in fluid communication with said second passage.

8. The improved premix secondary fuel nozzle of claim 7 wherein at least one of said first injector holes is angled in the circumferential direction.

9. The improved premix secondary fuel nozzle of claim 1 wherein said means for transferring said fluid medium comprises a generally annular passageway extending from upstream of said first injector to said second injector.

10. The improved premix secondary fuel nozzle of claim 1 wherein said plate thickness is at least 0.125 inches.

11. The improved premix secondary fuel nozzle of claim 10 wherein said cooling holes of said tip plate are generally perpendicular to said second surface such that said hole length L equals said plate thickness.

12. The improved premix secondary fuel nozzle of claim 11 wherein said cooling holes have a diameter D ranging from 0.020 inches to 0.070 inches.

13. The improved premix secondary fuel nozzle of claim 1 wherein said cooling holes of said tip plate are oriented at an angle $\alpha$ with respect to said second surface.

14. The improved premix secondary fuel nozzle of claim 13 wherein said angle $\alpha$ ranges from 25 degrees to 45 degrees.

15. The improved premix secondary fuel nozzle of claim 14 wherein said cooling holes have a diameter D ranging from 0.020 inches to 0.070 inches.

16. The improved premix secondary fuel nozzle of claim 15 wherein said hole length L of said cooling holes is greater than said plate thickness.

* * * * *